United States Patent [19]

Buxbaum

[11] 4,274,030

[45] Jun. 16, 1981

[54] THERMIONIC CATHODE

[75] Inventor: Charley Buxbaum, Baden, Switzerland

[73] Assignee: BBC Brown, Boveri & Company, Limited, Baden, Switzerland

[21] Appl. No.: 26,649

[22] Filed: Apr. 3, 1979

[30] Foreign Application Priority Data

May 5, 1978 [CH] Switzerland ..... 4890/78

[51] Int. Cl.[3] ..... H01J 1/14; H01J 19/06; H01K 1/14

[52] U.S. Cl. ..... 313/346 R; 313/270; 313/337; 252/514

[58] Field of Search ..... 313/346, 341, 337, 270; 252/514

[56] References Cited

U.S. PATENT DOCUMENTS

| | | | |
|---|---|---|---|
| 3,243,638 | 3/1966 | Affleck | 313/346 R |
| 3,373,307 | 3/1968 | Zalm et al. | 313/346 R |
| 3,437,865 | 4/1969 | Gabor et al. | 313/346 R |
| 3,454,816 | 7/1969 | Hoffmann et al. | 313/346 R |
| 3,497,757 | 2/1970 | Zalm et al. | 313/346 R |
| 3,531,679 | 9/1970 | Katz | 313/346 R |
| 3,967,150 | 6/1976 | Lien et al. | 313/348 |
| 4,019,081 | 4/1977 | Buxbaum et al. | 313/346 R |
| 4,083,811 | 4/1978 | Bachmann et al. | 313/346 R |
| 4,096,406 | 6/1978 | Miram et al. | 313/348 |
| 4,165,473 | 8/1979 | Falce | 313/346 R |

*Primary Examiner*—Saxfield Chatmon, Jr.
*Attorney, Agent, or Firm*—Oblon, Fisher, Spivak, McClelland & Maier

[57] ABSTRACT

A reaction thermionic cathode of the diffusion type on the basis of an activated high-temperature support metal doped with a diffusion-promoting additive for the activator substance, provided with a barrier layer inhibiting the self-diffusion of this additive in an undesired direction.

9 Claims, 6 Drawing Figures

THERMIONIC CATHODE

BACKGROUND OF THE INVENTION

1. Field of the Invention

This invention concerns a thermionic cathode on the basis of a high-melting point support metal, an activator substance in the form of the oxide of a metal of group IIIb, a reducing agent in the form of the carbide of the support metal and an additive promoting the diffusion of the activator substance to the active surface.

2. Description of the Prior Art

Thermionic cathodes for vacuum tubes are known in the art in numerous configurations and material combinations. They range from the classic oxide cathodes with low operating temperature and limited emission-current density but long life up to complicated multi-material systems of the so-called reaction cathode type in particular. Included among the latter are, above all, cathode materials of the type $W/W_2C/ThO_2$ ("thoriated tungsten cathodes") working via chemical exchange and supply of the activator substance from within and exhibiting a relatively high operating temperature. Such are distinguished by long life and moderate emission-current density. It has been possible to show further that the work function of the electrons could be reduced by addition of a platinum metal to the system, thus improving the latter's emission characteristics (e.g. DE-OS No. 1 614 541).

Still other material combinations are known which permit enhancement of the emission-current density with medium lifetime, among which to be chiefly mentioned are the systems $Mo/Mo_2C/La_2O_3$ (as in DE-AS No. 2 344 936) and $Mo/Mo_2C/La_2O_3$/Pt-metal and the like (as in DE-AS No. 2 454 569). Thermionic cathodes are also known which are based on porous sintered masses made from powder mixtures of a high-melting point metal with a platinum metal, the pores being filled with a material containing the activator substance (e.g. DE-OS No. 2 727 187). Such cathodes are distinguished, above all, by high emission-current densities at relatively low operating temperatures.

The expected life of the aforementioned cathodes is, in view of the operating temperatures mostly still to be considered as relatively high, insufficient for many applications. It has now been found that in cathode materials containing a platinum metal as a diffusion-promoting additive (e.g. the system $Mo/Mo_2C/La_2O_3Pt$) both the lifetime and emissivity of the monatomic activator layer are closely dependent on the concentration and lifetime of the diffusion-promoting additive in the active surface layer of the cathode. The maintenance of a dense layer of this additive depends, on the one hand, on its evaporation rate at the surface and, on the other, on its rate of diffusion into the cathode interior. Both factors are strongly temperature dependent, so that the cathode lifetime, in the end, also has limits set from this side. In the usual reaction cathodes the operability is adversely affected from the start by the uncontrollable and inwardly diffused, into the support metal, fraction of diffusion-promoting additive so that the supply of the latter in the surface layer is prematurely exhausted.

The problem with what the invention is concerned is to develop a thermionic cathode which, independently of shape and production method as well as textural constitution, makes possible an optimal utilization of materials at high emission-current densities and guarantees the longest possible life even under the most severe operating conditions.

SUMMARY OF THE INVENTION

This is achieved in the present invention by providing in the thermionic cathode defined at the outset, for lowering the self-diffusion of the said diffusion-promoting additive inwards away from the active cathode surface, a layer of material inhibiting diffusion of the said additive on the opposite side, from the active surface, of the layer containing the diffusion promoting additive or formed entirely by the latter.

The fundamental idea of the invention stems from the knowledge that the temperature dependence of the self-diffusion of the diffusion-promoting additive (e.g. platinum) into the interior of the support metal (e.g. molybdenum) is considerably steeper than that of its evaporation. In other words, the percentage of the additive diffusing from the coated surface into the cathode interior is higher the higher the operating temperature. Thus, at the higher temperature necessary for attaining a high emission-current density the cathode surface loses a disproportionately larger percentage of diffusion-promoting additive. On the other hand it has been found that the concentration of this additive promoting the diffusion of the activator substance into the support metal may be chosen to be considerably lower than was previously assumed. The life of the cathode can then be significantly increased by introduction of an additional layer inhibiting the self-diffusion of the additive into the interior of the cathode.

The condition is placed on such a barrier layer that it not otherwise adversely affect the chemico-thermodynamic equilibrium nor the corresponding reaction kinetics of the materials involved. In particular, it must not influence the diffusion of the activator substance to the cathode surface. Further, the barrier layer must form no alloy with the diffusion-promoting additive which alters the activator substance chemico-physically and could decrease its diffusion to the cathode surface.

The above mentioned conditions are satisfied, above all, by elements with grain-boundary diffusion into the interior of the cathode less than that of the simultaneously used diffusion-promoting additive for the activator substance used. Furthermore, those elements will work to advantage the vapor pressure of which at the operating temperature is lower than that of the simultaneously used diffusion-promoting additive. If, for instance, the latter consists of platinum or an allow containing mainly this metal, there can then be especially used for the barrier layer hafnium, rhenium, ruthenium, osmium or iridium along with alloys of these elements as well as a palladium/rhenium alloy. Quite generally it can be stated that in case the diffusion promoting additive consists of a platinum metal, another platinum metal or an otherwise suitable metal with lower vapor pressure can be used for the barrier layer.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
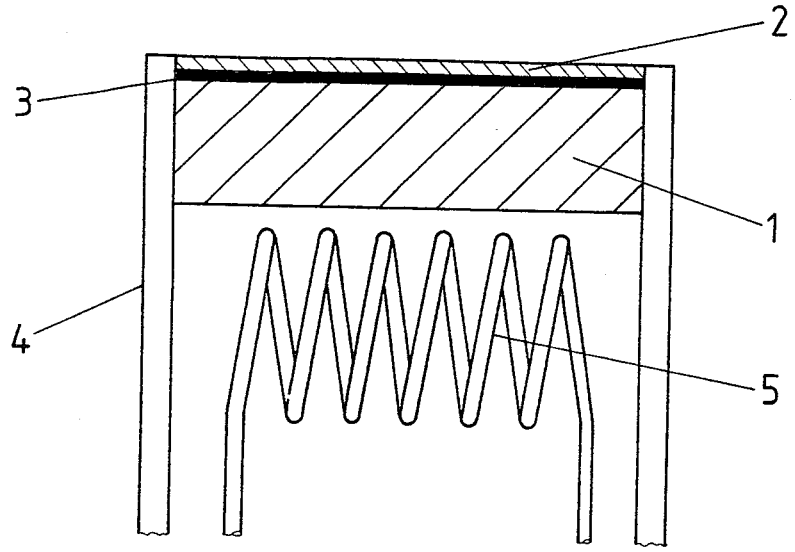
FIG. 1 shows a cross section through a sintered platelet acting as cathode.

As an example, in the embodiment of FIG. 1, 98% molybdenum powder was mixed, pressed and sintered with 2% lanthanum oxide powder. A platelet was cut from the heat-treated sintered mass and its surface polished and coated with rhenium by an electrolytic process. The thickness of the barrier layer averaged 5μ and can vary within the limits of 1 to 20μ. The platelet was then provided with a 10μ thick platinum layer, likewise applied electrolytically. This surface layer can advantageously be 1 to 50μ thick. The sintered platelet was then carburized in a benzene-hydrogen mixture.

FIG. 1 shows the structure of the cathode in cross section wherein reference numeral 1 designates the sintered body consisting of support metal (e.g. molybdenum) and an activator substance held in a frame 4 of high-temperature material (e.g. likewise molybdenum) and heated indirectly by a heater coil 5. The barrier layer 3 of diffusion-inhibiting material (e.g. rhenium) is located on the active side of the cathode, immediately beneath the surface layer 2 of platinum metal.

The cathode can also be designed for direct-heating, whereby the heater coil 5 and frame 4 are eliminated or replaced by other structural elements. The sintered body can then also exhibit a form other than that shown in FIG. 1.

Figure 2:
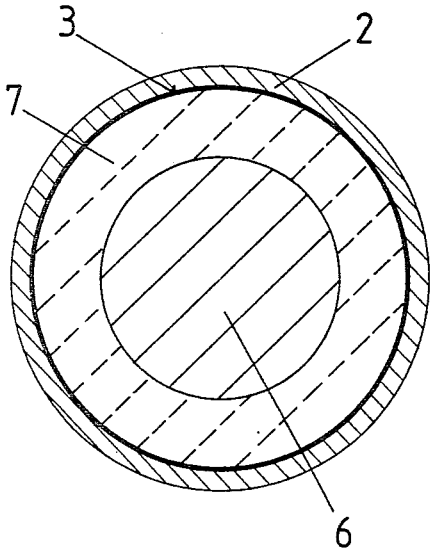
FIG. 2 shows a cross sectional view through a cathode wire with layered structure of the activator substance.

A second example of the present invention is shown in FIG. 2 wherein 99% molybdenum powder and 1% lanthanum oxide powder were mixed, pressed and sintered to produce a casing and then mechanically worked to a hollow cylinder. To produce a core, 97% molybdenum powder was worked with 3% lanthanum oxide powder into a rod by the same procedure. The rod was inserted in the casing and the assembly reduced to a smaller diameter by round-forging. The resultant wire of 3 mm diameter was then carburized in a benzene-hydrogen mixture, next provided with a galvanically deposited rhenium layer of 5μ thickness and finally with a 10μ thick platinum layer.

FIG. 2 shows the cross section through such a cathode wire with a layered structure of the activator substance. The core zone 6 of the support metal (e.g. molybdenum) is doped with a relatively high content of activator substance (e.g. lanthanum oxide). Next to the core zone 6 is a layer 7 with a low content of activator substance. Following that is the barrier layer 3 of diffusion-inhibiting material (e.g. rhenium) and, outermost, the surface layer 2 of platinum metal (in this case, platinum).

Figure 3:
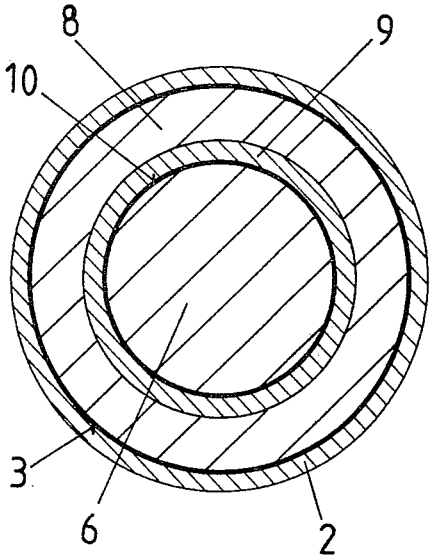
FIG. 3 shows a cross sectional view through a cathode wire with a diffusion-promoting additive as an intermediate layer.

By the method given in FIG. 2 a core and a casing were produced as shown in FIG. 3, both of which exhibited the same concentration of activator substance lanthanum oxide, viz. 3%. Before insertion the core was provided with an electrolytically deposited rhenium layer 20μ thick and a 100μ thick platinum coating. The layer thicknesses can vary between 5μ and 50μ for the rhenium and between 20μ and 200μ for the platinum. The assembled core and casing was then reduced to a diameter of 3 mm by round-forging and drawn to one of 1 mm and then carburized. The wire was finally provided with galvanically applied layers of rhenium and platinum 3μ and 15μ thick, respectively.

The cross section of the finished wire is seen in FIG. 3 wherein reference numeral 6 indicates the core zone with high activator substance content and reference numeral 8 the corresponding, likewise highly doped peripheral layer. The barrier layer 10 of diffusion inhibiting material (e.g. rhenium) is immediately beneath the intermediate layer 9 of platinum metal. The surface layers 2 and 3 correspond to those of FIG. 2. The surface layer 2 of platinum metal can even be omitted if necessary, whereupon at first the barrier layer 3 assumes the role of the diffusion-promoting additive in the peripheral zone, until sufficient platinum metal is diffused out of the interior to the surface. Thanks to numerous alloy-forming possibilities between layers 2 and 3, further material combinations with different graduated functions are feasible as well.

Figure 4:
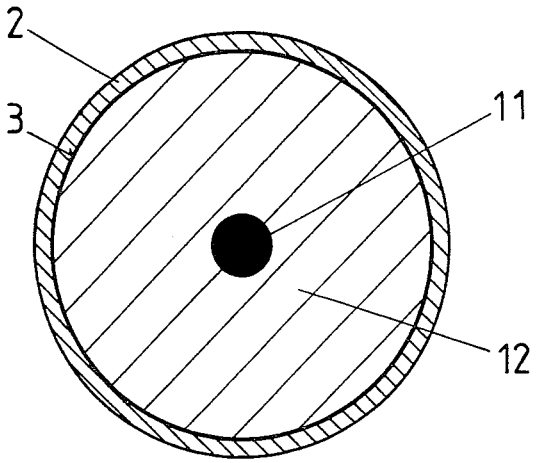
FIG. 4 shows a cross sectional view through a cathode wire with a diffusion-promoting additive as a core.

In the embodiment of FIG. 4, 96% molybdenum powder and 4% lanthanum oxide powder for production of a sleeve were mixed, pressed, sintered and then mechanically worked to form a hollow cylindrical rod. A tight-fitting platinum wire was inserted in the hole and the combination round-forged to a diameter of 4 mm. The wire prepared in this manner was provided by the method of FIG. 2, with an 8μ thick rhenium layer and a 20μ thick platinum layer and then carburized.

The cross section of the cathode wire is shown schematically in FIG. 4 wherein reference numeral 11 designates the core of diffusion-promoting additive (platinum metal, in this instance platinum) while reference numeral 12 indicates the support-metal sleeve (here molybdenum) highly doped with activator substance. The surface layer 2 of platinum metal (platinum) lies over the barrier layer 3 of diffusion-inhibiting material (rhenium).

Figure 5:
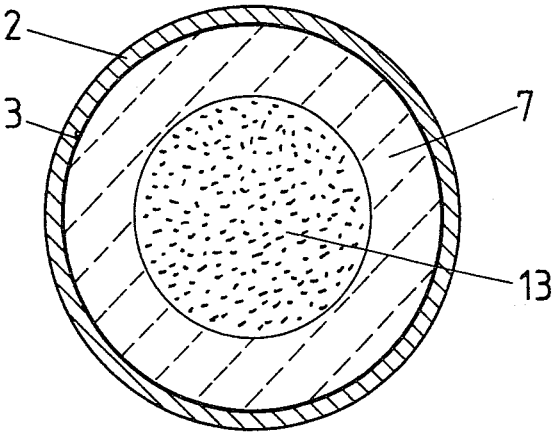
FIG. 5 shows a cross sectional view through a cathode wire with a finely divided diffusion-promoting additive in the core zone.

In FIG. 5, 6 the method given in FIG. 2, a core and a casing were fabricated where, however, there was added to the powdered ingredients of the core an extra 0.5% of platinum black. The further working proceeded analogously to the process steps mentioned in FIG. 2. The round-forged wire with a 4μ thick rhenium layer and a 25μ thick platinum layer exhibited a diameter of 3.5 mm.

FIG. 5 shows the layered structure of such a cathode wire. The core zone 13 of support metal (e.g. molybdenum) has a relatively high content of activator substance (lanthanum oxide) and is doped, besides, with finely divided platinum as diffusion-promoting additive. The peripheral layer 7 with low activator substance content carries in turn the surface layers 2 and 3 corresponding to those in FIG. 2.

Figure 6:
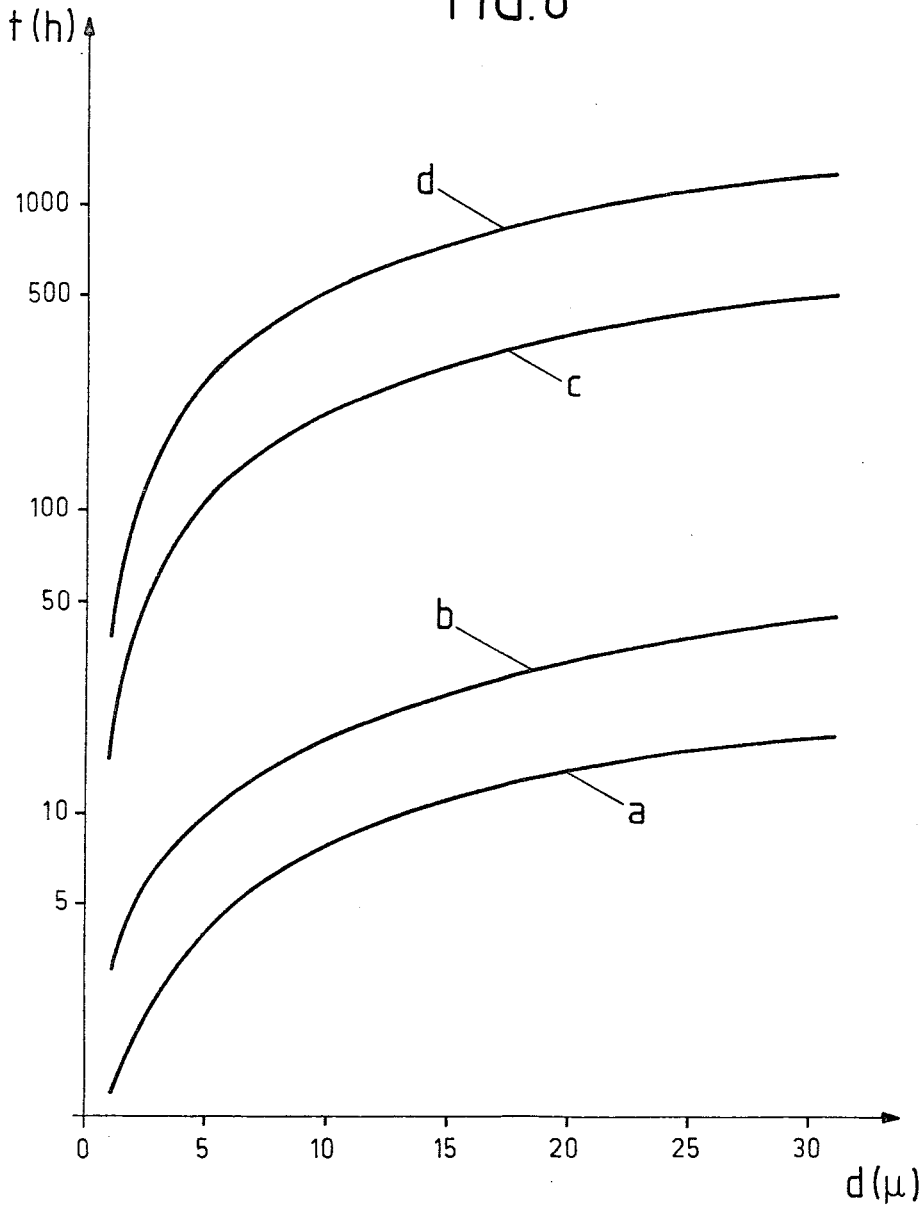
FIG. 6 is a diagram of the lifetime as a function of the thickness of the diffusion-promoting additive for a round-forged cathode wire with and without a boundary layer.

In FIG. 6 is presented a diagram showing the lifetime as a function of the layer thickness of the diffusion-promoting additive for a round-forged cathode wire as in FIG. 3. The effects of the barrier layer and operating temperature are characterized by different curves. The curves "a" and "b" relate to an operating temperature of 2050° K., the curves "c" and "d" to one of 1880° K.

The layer thickness of the diffusion-promoting additive (platinum) in $\mu$'s is given directly as the absissa while the cathode life in hr's is given logarithmically as the ordinate. Curves "a" and "c" are the reference curves for thermionic cathode without barrier layer, on the basis of molybdenum as support metal, molybdenum carbide as reducing agent and platinum as diffusion-promoting additive. Curves "b" and "d" represent the corresponding curves for thermionic cathodes with an additional rhenium barrier layer of $5\mu$ thickness. The operating pressure in the electron tubes was $5\times10^{-4}$ Torr. From comparison of the curves it follows that the lifetime was increased by the rhenium layer to 2.5 times the original value on the average.

The invention is not limited to the configurations described in the foregoing examples. It can also be applied to advantage to other material combinations than those discussed above. Besides the system $Mo/Mo_2C/La_2O_3/Pt$ there comes under consideration also mainly the systems $W/W_2C/ThO_2/Ru$ and $Ta/Ta_2C/Y_2O_3/Pd$. The proposed barrier layer may be used quite generally with all material combinations of diffusion-type reaction cathodes doped with a diffusion-promoting additive, in order to reduce or completely halt an unpleasant self-diffusion of the additive in an undesired direction.

Though the new thermionic cathode of the invention components for electron tubes created make possible, at high emission-current densitites, the best utilization of available materials and guarantee a long lifetime, the barrier layer permits directing the chemico-physical processes largely in the desired direction and effective limiting of deleterious side effects during operation.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A thermionic dispenser cathode comprising:
   - a high-melting point metal support comprising an activator substance in the form of an oxide of a metal of group IIIb and a reducing agent in the form of a carbide of the metal support;
   - a layer of diffusion promoting additive for promoting diffusion of the activator substance; and
   - a layer of material on said metal support beneath the diffusion promoting layer for inhibiting self-diffusion of the diffusion-promoting additive inwards away from the active cathode surface.

2. A thermionic cathode as set forth in claim 1, wherein the operating temperature of the diffusion-inhibiting material exhibits a lower vapor pressure than that of the diffusion-promoting additive.

3. A thermionic cathode as set forth in claims 1 or 2, wherein the layer of diffusion-promoting additive is selected from the group consisting of a platinum metal or an alloy of at least two platinum metals, and the diffusion-inhibiting material is selected from the group consisting of hafnium, rhenium, ruthenium, osmium or iridium or an alloy of the aforesaid elements, as well as a palladium/rhenium alloy.

4. A thermionic cathode as set forth in claim 1 or 2, wherein the diffusion-inhibiting material consists of at least one of the elements selected from the group consisting of hafnium, rhenium, ruthenium, osmium or iridium.

5. A thermionic cathode as set forth in claim 3, wherein the layer of diffusion-promoting additive consists of platinum and the diffusion-inhibiting material consists of rhenium.

6. A thermionic cathode as set forth in claim 1, wherein the support metal comprises molybdenum, the reducing agent comprises molybdenum carbide, the activator substance consists of lanthanum oxide, the layer of diffusion-promoting additive is selected from the group consisting of platinum or a platinum alloy and the diffusion-inhibiting material comprises rhenium.

7. A thermionic cathode as set forth in claim 1, wherein the layer of diffusion-promoting additive has a thickness of 1 to $50\mu$ and the diffusion-inhibiting material comprises a layer having a thickness of 1 to $20\mu$.

8. A thermionic cathode as set forth in claim 1 or 7, wherein the cathode is in the form of a sintered mass, where the content of the layer activator substance is distributed essentially uniformly over the support metal cross section and an active surface of the cathode is provided with the layer of the diffusion-inhibiting material, over which is disposed the layer of the diffusion-promoting additive.

9. A thermionic cathode as set forth in claim 1 or 7, wherein said cathode is in the form of a wire, ribbon or sheet, a cross section thereof exhibiting a layered structure with respect to concentration and/or arrangement of the activator substance embedded in the support metal, and the layer of diffusion-promoting additive forms the surface layer and/or an intermediate layer, under which there is disposed a layer of the diffusion-inhibiting material.

* * * * *